United States Patent [19]

Alderman

[11] 4,266,448

[45] May 12, 1981

[54] AXE SHARPENING DEVICE

[76] Inventor: James Alderman, P.O. Box 324, Kellogg, Id. 83837

[21] Appl. No.: 963,727

[22] Filed: Nov. 27, 1978

[51] Int. Cl.[3] ..... B21K 11/10

[52] U.S. Cl. ..... 76/82

[58] Field of Search ..... 29/90 R, 76 R; 76/82, 76/88, 82.2; 269/126, 128

[56] References Cited

U.S. PATENT DOCUMENTS

| | | | |
|---|---|---|---|
| 1,124,092 | 1/1915 | Wilson | 76/82 |
| 1,904,075 | 4/1933 | Petrich | 76/82.2 |
| 2,012,513 | 8/1935 | Maze | 76/82 |
| 2,211,242 | 8/1940 | McIntosh | 269/128 |
| 2,455,014 | 11/1948 | Lee | 76/82 |
| 2,455,477 | 12/1948 | Girard | 76/82 |
| 3,654,823 | 4/1972 | Juranitch | 76/82 |
| 3,730,023 | 5/1973 | Otto | 76/82 |
| 3,924,360 | 12/1975 | Haile | 76/82 |

*Primary Examiner*—Othell M. Simpson
*Assistant Examiner*—Roscoe V. Parker
*Attorney, Agent, or Firm*—Wells, St. John & Roberts

[57] ABSTRACT

An axe sharpening device which comprises an adjustable two piece axe-clamping element having on the upper part thereof a file guide including a base oscillatably mounted on the upper part of the axe clamp with an upper part pivoted thereto and fitted with clamping means holding the file against a pivot pin. Resilient strips are provided on the axe clamping element to securely engage the axe head and to prevent it from slipping.

1 Claim, 4 Drawing Figures

FIG. 1
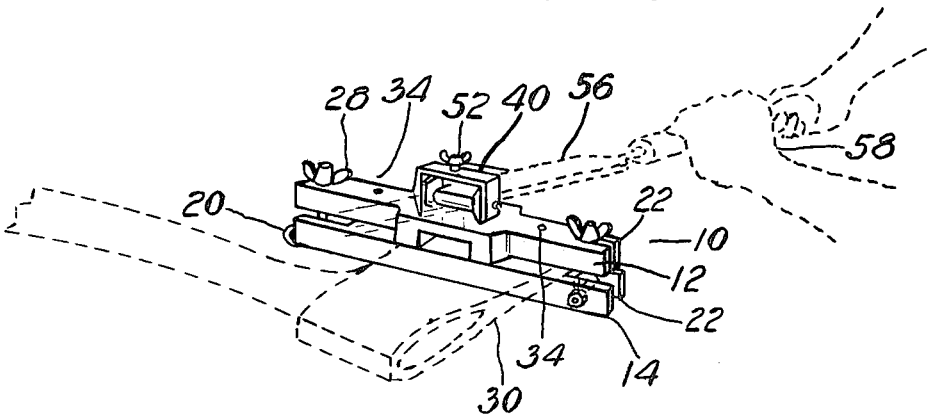
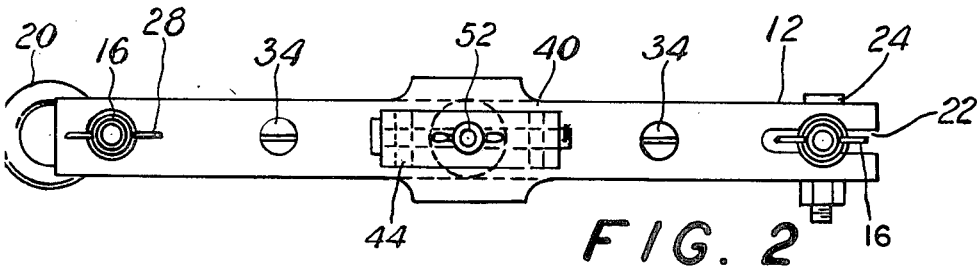
FIG. 2
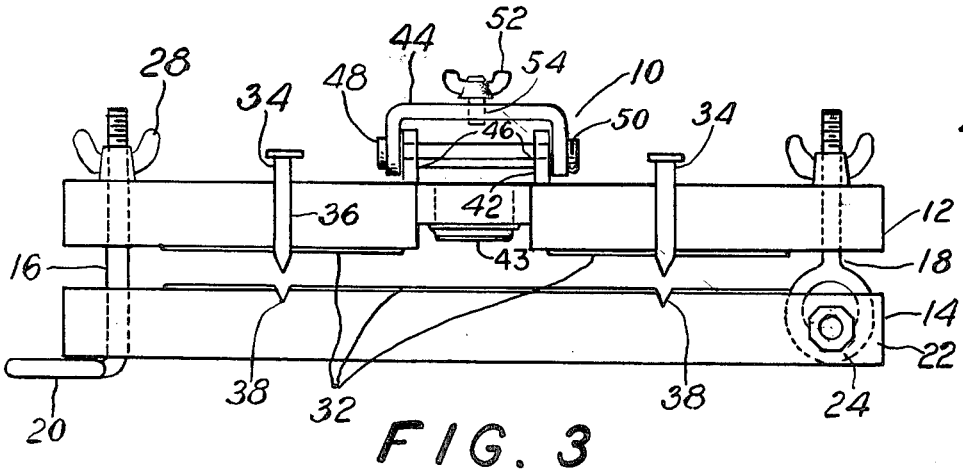
FIG. 3
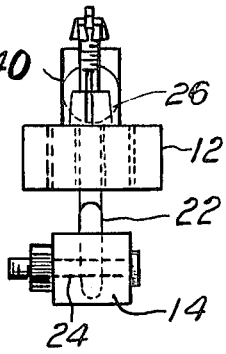
FIG. 4

AXE SHARPENING DEVICE

FIELD OF THE INVENTION

This invention relates generally to a device for sharpening axe heads with a file.

DESCRIPTION OF THE PRIOR ART

The prior art, as exemplified by U.S. Pat. Nos. 3,730,023; 3,924,360; 2,455,014; 2,012,513; 1,124,092; and 3,654,823 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual skill and/or dexterity to operate. As a result of the shortcomings of the prior art, typified by the above, there has developed a substantial need for improvement in this field.

The principal object of this invention is to provide a device or article of readily merchandizable character which combines simplicity, strength and durability in a high degree, together with inexpensiveness of construction owing to a minimum of parts so as to encourage widespread use thereof.

Additional objects and advantages of the invention will be set forth in part in the description which follows and in part will be obvious from the description, or may be realized by practice of the invention, the objects and advantages being realized and attained by means of the instrumentalities and combinations particularly pointed out in the appended claims.

SUMMARY OF THE INVENTION

This invention resides in an axe sharpening device which comprises an adjustable two piece axe-clamping element having on the upper part thereof a file guide including a base oscillatably mounted on the upper part of the axe clamp with an upper part pivoted thereto and fitted with clamping means holding the file against a pivot pin. Resilient strips are provided on the axe clamping element to securely engage the axe head and to prevent it from slipping.

BRIEF DESCRIPTION OF THE DRAWING

In the accompanying drawing, in which is shown one of the various possible illustrative embodiments of this invention, wherein like reference character identify the same or like parts:

FIG. 1 is a view in perspective showing use of the device of this invention in sharpening an axe head;

FIG. 2 is a top planar view of same;

FIG. 3 is a front elevation of the device; and

FIG. 4 is a side view of the device.

BRIEF DESCRIPTION OF THE PREFERRED EMBODIMENTS

With reference to the drawing, there is shown and illustrated an improved axe head sharpener constructed in accordance with the principles of the invention and designated generally by reference character 10. The illustrated tangible embodiment of the invention includes an axe head clamp comprising an upper plate 12 and a lower plate 14 of metal or hard plastic held in spaced relation by eye-bolts 16, 18 which pass through openings near their extremities. Eye-bolt 16 has its eye

20 bent at ninety degrees to plate 14 from which it projects so as to form means for attaching the device to a belt. One end of plates 12, 14 has a slot 22 through which passes eye-bolt 18 whose eye 22 is traversed by ¼ inch diameter bolt 24. The threaded part of the eye-bolt 18 has wing nut 26 screwed thereon. A similar nut 28 is screwed on bolt 16. It will be appreciated that by loosening nut 26, bolt 16 may be moved vertically between slots 22 to allow entry of axe head 30 between plates 12 and 14 which form the clamp for head 30.

As shown in FIG. 3, resilient plastic or rubber strips 32 are glued or otherwise secured to the bottom of plate 12 and the top of plate 14 to form gripping means which act on axe head 30 to prevent it from slipping. Cap screws 34 with sixty degree points pass through holes 36 drilled in plate 12 and act on axe head 30 to secure it in place. Notches 38 in register with the cap screws are provided in the upper part of plate 14 to receive the cap screws when the device is not in use.

A guide 40 is oscillatably mounted on the center of the upper part of plate 12. Guide 40 comprises a yoke 42 pivoted on plate 12 by pivot pin 43 and a clamp 44 pivoted on the vertical arms 46 of the yoke by a horizontal pivot bolt 48 held in place by cotter pin 50 (FIG. 3). A wing bolt 52 passes through a central opening 54 in clamp 44 for locking file 56 in place.

It will be seen from the above that file 56 when held by guide 40 may be turned and also rocked on device 10 so as to have substantially universal movement.

In use, the head 30 is fixed in position between strips 32 of the plates 12 and 14 and wing nuts 26, 28 and cap screws 34 are tightened thereover. File 56 is clamped in guide 40 by means of wing nut 52. Using handle 58, slight downward pressure is exerted with the file first on the left edge side of the axe head and left to right and then the pressure is released on the back stroke. The back and forth motion is repeated until the edge of the head is sharp. The head is then removed and turned over, repeating the process from right to left.

The operation and use of the invention hereinabove described will be evident to those skilled in the art to which it relates from a consideration of the foregoing.

The present invention is believed to accomplish among others all of the objects and advantages herein set forth.

Without further analyses, the foregoing will so fully reveal the gist of this invention that those skilled in the art can by applying current knowlege thereto readily adapt it for various applications without omitting certain features which can constitute essential characteristics of the generic or specific aspects of this invention. Therefore, a more lengthy description is deemed unnecessary.

It is intended that various changes may be made in this invention in the practical development thereof, if desired. Such changes are comprehended within the meaning and range of equivalency of the following claims. The invention, therefore, is not to be restricted except as is necessitated by the prior art.

Having thus described the invention, what is claimed as new and to be secured by Letters Patent is:

1. An axe head sharpening device comprising:

a clamp composed of an upper and a lower plate adapted to receive said head therebetween;

resilient strips on said plates adapted to contact and grip said head;

tightening means for securing said plates on said head;

a guide for a file;

said guide being mounted on said upper plate for substantially universal movement about said plate;

wherein said plates have slots at one end thereof;

said tightening means consisting of eye-bolts at each extremity of said plates;

one of said eye-bolts having its eye pivoted in said slot of said lower plate whereby said eye-bolt is able to pivot into and out of said slots to allow entry of said axe head between said plates; and wherein the other of said eye-bolts has its eye bent perpendicular to and below said lower plate to serve as means for attaching the device to a belt for storage.

* * * * *